US009855590B2

(12) United States Patent
Ogata et al.

(10) Patent No.: US 9,855,590 B2
(45) Date of Patent: Jan. 2, 2018

(54) STEEL-SHEET SNAKING PREVENTING DEVICE AND STEEL-SHEET SNAKING PREVENTING METHOD FOR VERTICAL LOOPER

(71) Applicant: JFE Steel Corporation, Tokyo (JP)

(72) Inventors: Takashi Ogata, Fukuyama (JP); Kyosuke Kasahara, Fukuyama (JP); Yosuke Harai, Fukuyama (JP); Seishi Hatakeyama, Fukuyama (JP)

(73) Assignee: JFE Steel Corporation (JP)

( * ) Notice: Subject to any disclaimer, the term of this patent is extended or adjusted under 35 U.S.C. 154(b) by 95 days.

(21) Appl. No.: 14/648,756

(22) PCT Filed: Sep. 4, 2013

(86) PCT No.: PCT/JP2013/005225

§ 371 (c)(1),
(2) Date: Jun. 1, 2015

(87) PCT Pub. No.: WO2014/091642

PCT Pub. Date: Jun. 19, 2014

(65) Prior Publication Data

US 2015/0306649 A1 Oct. 29, 2015

(30) Foreign Application Priority Data

Dec. 12, 2012 (JP) ..... 2012-270862
Aug. 22, 2013 (JP) ..... 2013-171835

(51) Int. Cl.
*B21B 39/08* (2006.01)
*B65H 20/24* (2006.01)
(Continued)

(52) U.S. Cl.
CPC ..... *B21B 39/084* (2013.01); *B21C 49/00* (2013.01); *B65H 20/24* (2013.01); *B65H 20/34* (2013.01);
(Continued)

(58) Field of Classification Search
CPC ..... B65H 20/24; B65H 20/32; B65H 20/34; B21B 39/084; B21C 49/00
See application file for complete search history.

(56) References Cited

U.S. PATENT DOCUMENTS 5,172,579 A * 12/1992 Nojima ..... B21B 37/68 700/152
5,810,236 A * 9/1998 Yoshida ..... B65H 20/34 226/118.3
(Continued)

FOREIGN PATENT DOCUMENTS

JP 2-93017 U 7/1990
JP 2-127320 U 10/1990
(Continued)

OTHER PUBLICATIONS

Machine translation for 08-024957, also published as JP 04-339520, retrieved Dec. 1, 2016.*
(Continued)

*Primary Examiner* — Michael C McCullough
(74) *Attorney, Agent, or Firm* — DLA Piper LLP (US)

(57) ABSTRACT

A steel-sheet snaking preventing device for a vertical looper includes a jack mechanism provided at each of at least two corners of a looper carriage and coupled via a metal fitting to a chain or a wire rope that pulls the looper carriage; a tilt meter configured to detect the amount of tilt of the looper carriage; a level meter configured to detect a height of the looper carriage; and a means for receiving detection signals from the tilt meter and the level meter, determining the
(Continued)

amount of tilt of the looper carriage at which the amount of snaking of a steel sheet becomes zero, sending the determined amount of tilt of the looper carriage as a command to the jack mechanism, and controlling the amount of tilt of the looper carriage by the jack mechanism.

3 Claims, 11 Drawing Sheets

(51) Int. Cl.

| | |
|---|---|
| ***B21C 49/00*** | (2006.01) |
| ***B65H 20/34*** | (2006.01) |
| *B21C 47/34* | (2006.01) |
| *B65H 23/032* | (2006.01) |
| *B65H 23/038* | (2006.01) |

(52) U.S. Cl.
CPC ..... *B21C 47/3425* (2013.01); *B65H 23/038* (2013.01); *B65H 23/0326* (2013.01); *B65H 2511/214* (2013.01); *B65H 2701/173* (2013.01)

(56) References Cited

U.S. PATENT DOCUMENTS

| | | | | |
|---|---|---|---|---|
| 8,382,097 | B2 * | 2/2013 | Chiba | B65H 1/14 271/147 |
| 2012/0146282 | A1 * | 6/2012 | Chiba | B65H 1/14 271/160 |

FOREIGN PATENT DOCUMENTS

| | | |
|---|---|---|
| JP | 04-339520 | 11/1992 |
| JP | 5-263297 | 10/1993 |
| JP | 08-168819 | 7/1996 |
| JP | 8-267139 | 10/1996 |
| JP | 2001-330424 | 11/2001 |
| JP | 2012-223771 | 11/2012 |
| JP | 2013-184166 | 9/2013 |

OTHER PUBLICATIONS

Supplementary European Search Report dated Feb. 11, 2016 of corresponding European Application No. 13862224.6.

* cited by examiner

PRIOR ART

PRIOR ART

STEEL-SHEET SNAKING PREVENTING DEVICE AND STEEL-SHEET SNAKING PREVENTING METHOD FOR VERTICAL LOOPER

TECHNICAL FIELD

This disclosure relates to a steel-sheet snaking preventing device and a steel-sheet snaking preventing method for a vertical looper used, for example, in a continuous annealing facility in a steelmaking plant.

BACKGROUND

In a continuous production line that produces a galvanized steel sheet, a vertical looper is provided as a measure against variation in the speed of conveying the steel sheet and also as a measure to connect the steel sheets. The vertical looper is configured to store a predetermined amount of steel sheet.

As illustrated in FIG. 15, the vertical looper includes plural pairs of upper and lower rolls (upper looper rolls 33 and lower looper rolls 34). The steel sheet 30 runs while being wound alternately between the upper and lower rolls. The upper looper rolls 33 are arranged at predetermined intervals on a looper carriage 32, with which the upper looper rolls 33 are horizontally suspended. The looper carriage 32 is coupled, at four corners thereof, by four respective chains or wire ropes 36 via sprockets or sheaves 35 to drive sprockets or drums 38. Under control of a carriage driving mechanism 37, the drive sprockets or drums 38 take up or let out the chains or wire ropes 36 as necessary so that the upper looper rolls 33 are raised or lowered together with the looper carriage 32.

In a conventional vertical looper, due to tilting of a looper carriage caused by variation in the amount of elongation among chains or wire ropes during operation, or due to unevenness in the shape of a steel sheet, the steel sheet may snake and this may prevent proper operation. As a solution, the vertical looper has been operated under conditions where there is less occurrence of snaking. For example, the looper stroke (range of raising and lowering of the looper carriage) has been limited to reduce the occurrence of snaking. However, this has lowered the rate of capacity utilization. As another solution, snaking correction rolls may be installed in the vertical looper. However, the correction capability is limited because the number of installable rolls is limited due to space limitations.

Japanese Unexamined Patent Application Publication No. 8-267139 discloses a steel-sheet snaking preventing device for such a vertical looper. In that steel-sheet snaking preventing device for a vertical looper, as illustrated in FIG. 16, an edge position detector 42 detects a steel sheet edge on at least one of entry and exit sides of the vertical looper, and a displacement gauge 43 computes the amount of snaking of a steel sheet 30. On the basis of the result of this computation, a control means 44 drives jack mechanism driving sources 46 to cause jack mechanisms 41 to individually adjust the lengths of chains or wire ropes 36 that pull a looper carriage 32 so that the looper carriage 32 is tilted in the direction of the steel sheet width to prevent snaking of the steel sheet in the vertical looper.

The steel-sheet snaking preventing device for a vertical looper disclosed in Japanese Unexamined Patent Application Publication No. 8-267139 has a problem in that it makes the facility complex. That is, the chains or wire ropes may be elongated and the amount of elongation depends on the length and the load. Therefore, to tilt the looper carriage to prevent snaking on the basis of the detected amount of snaking of the steel sheet, the length of adjustment of each chain or wire rope needs to be determined by taking into account the overall length of the chains or wire ropes (i.e., looper carriage height) and the amount of elongation produced by load (tension) at that time. This requires detectors and controllers for the task, and thus makes the facility complex and costly.

Additionally, the conventional steel-sheet snaking preventing device for a vertical looper described above has a problem in that one-sided elongation of the steel sheet occurs when the looper stroke is short. A tensile stress $\sigma$ applied to an end portion of the steel sheet by tilting the looper carriage can be expressed as $\sigma=E\cdot\epsilon=E\cdot(\delta/L)$, where $\delta$ is an elongation at the end portion of the steel sheet, $\epsilon$ is an elongation strain, L is the steel sheet length between the upper and lower rolls, and E is the longitudinal elastic modulus of the steel sheet. If a value obtained by adding the unit tension UT of the steel sheet (which is obtained by dividing the steel sheet tension by the cross-sectional area of the steel sheet) to the tensile stress $\sigma$ exceeds the yield point $\sigma y$ of the steel sheet ($\sigma y<\sigma+UT$), one-sided elongation occurs due to plastic deformation of the end portion of the steel sheet. The smaller the steel sheet length L between the upper and lower rolls, the larger the tensile stress. Therefore, in a location where the looper stroke is short, it is necessary not only to tilt the looper carriage to prevent snaking, but also to tilt the looper carriage within a range where the one-sided elongation does not occur. However, one-sided elongation occurs in the conventional device because the looper carriage is tilted on the basis only of the amount of snaking of the steel sheet.

It could therefore be helpful to provide a steel-sheet snaking preventing device and a steel-sheet snaking preventing method for a vertical looper that can prevent snaking of a steel sheet with a simple facility.

SUMMARY

We thus provide:

(1) A steel-sheet snaking preventing device for a vertical looper, the device including a jack mechanism provided at each of at least two corners of a looper carriage and coupled via a metal fitting to a chain or a wire rope that pulls the looper carriage; a tilt meter configured to detect the amount of tilt of the looper carriage; a level meter configured to detect a height of the looper carriage; and a means for receiving detection signals from the tilt meter and the level meter, determining the amount of tilt of the looper carriage at which the amount of snaking of a steel sheet becomes zero, sending the determined amount of tilt of the looper carriage as a command to the jack mechanism, and controlling the amount of tilt of the looper carriage by the jack mechanism.

(2) A steel-sheet snaking preventing device for a vertical looper, the device including a jack mechanism provided at each of at least two corners of a looper carriage and coupled via a metal fitting to a chain or a wire rope that pulls the looper carriage; a tilt meter configured to detect the amount of tilt of the looper carriage; a snaking detector configured to detect the amount of snaking of a steel sheet in the looper; a level meter configured to detect a height of the looper carriage; and a means for receiving detection signals from the tilt meter, the snaking detector, and the level meter, sending the amount of raising or lowering of the corner of the looper carriage as a command to the jack mechanism, and controlling the amount of tilt of the looper carriage by the jack mechanism.

(3) A steel-sheet snaking preventing method for a vertical looper, the method including, for preventing snaking of a steel sheet using the steel-sheet snaking preventing device for a vertical looper according to (2), determining the amount of tilt of the looper carriage such that the amount of tilt does not exceed the allowable amount of tilt at which one-sided elongation of the steel sheet does not occur, on the basis of a predetermined relationship between the amount of snaking of the steel sheet, the amount of tilt of the looper carriage, and the height of the looper carriage.

In the steel-sheet snaking preventing device for a vertical looper, the snaking detector detects the amount of snaking of the steel sheet in the looper, and the level meter detects the height of the looper carriage. On the basis of the detection signals from the snaking detector and the level meter, the amount of raising or lowering of the corner of the looper carriage is determined by computation. On the basis of the result of this computation, the jack mechanism controls the amount of raising or lowering of the corner of the looper carriage such that the amount of snaking is within an allowable range. Thus, without varying the length of the chain or wire rope, it is possible to tilt the looper carriage in the direction of the steel sheet width and prevent snaking of the steel sheet in the looper with a simple facility. Also, by controlling the amount of raising or lowering of the corner of the looper carriage as described above, it is possible to minimize the tilt of the looper carriage and minimize a load applied to guide rolls and the like.

In the steel-sheet snaking preventing device for a vertical looper, the tilt meter detects the amount of tilt of the looper carriage, and the level meter detects the height of the looper carriage. On the basis of the detection signals from the tilt meter and the level meter, the amount of tilt of the looper carriage at which the amount of snaking becomes zero is determined. A raising or lowering command is sent to the jack mechanism, and the amount of tilt of the looper carriage is controlled in accordance with the command by the jack mechanism. Therefore, it is not necessary to take into account the overall length of the chain or wire rope (height of the looper carriage) and the amount of elongation produced by load (tension), and it is possible to prevent snaking of the steel sheet in the looper with a simple facility.

In the steel-sheet snaking preventing device for a vertical looper, the snaking detector detects the amount of snaking of the steel sheet in the looper, and the tilt meter detects the amount of tilt of the looper carriage. On the basis of the detection signals from the snaking detector and the tilt meter, a command to raise or lower the corner of the looper carriage is sent to the jack mechanism such that the amount of snaking is minimized, and the amount of tilt of the looper carriage is controlled in accordance with the command by the jack mechanism. Therefore, it is not necessary to take into account the overall length of the chain or wire rope (height of the looper carriage) and the amount of elongation produced by load (tension), and it is possible to prevent snaking of the steel sheet in the looper with a simple facility. Also, the level meter detects the height of the looper carriage and, in accordance with the detection signal from the level meter, the amount of tilt of the looper carriage detected by the tilt meter is controlled within a range where an end portion of the steel sheet is not plastically deformed. Therefore, it is possible to prevent snaking without causing one-sided elongation of the steel sheet in a location where the looper stroke is short.

REFERENCE SIGNS LIST

Figure 1:
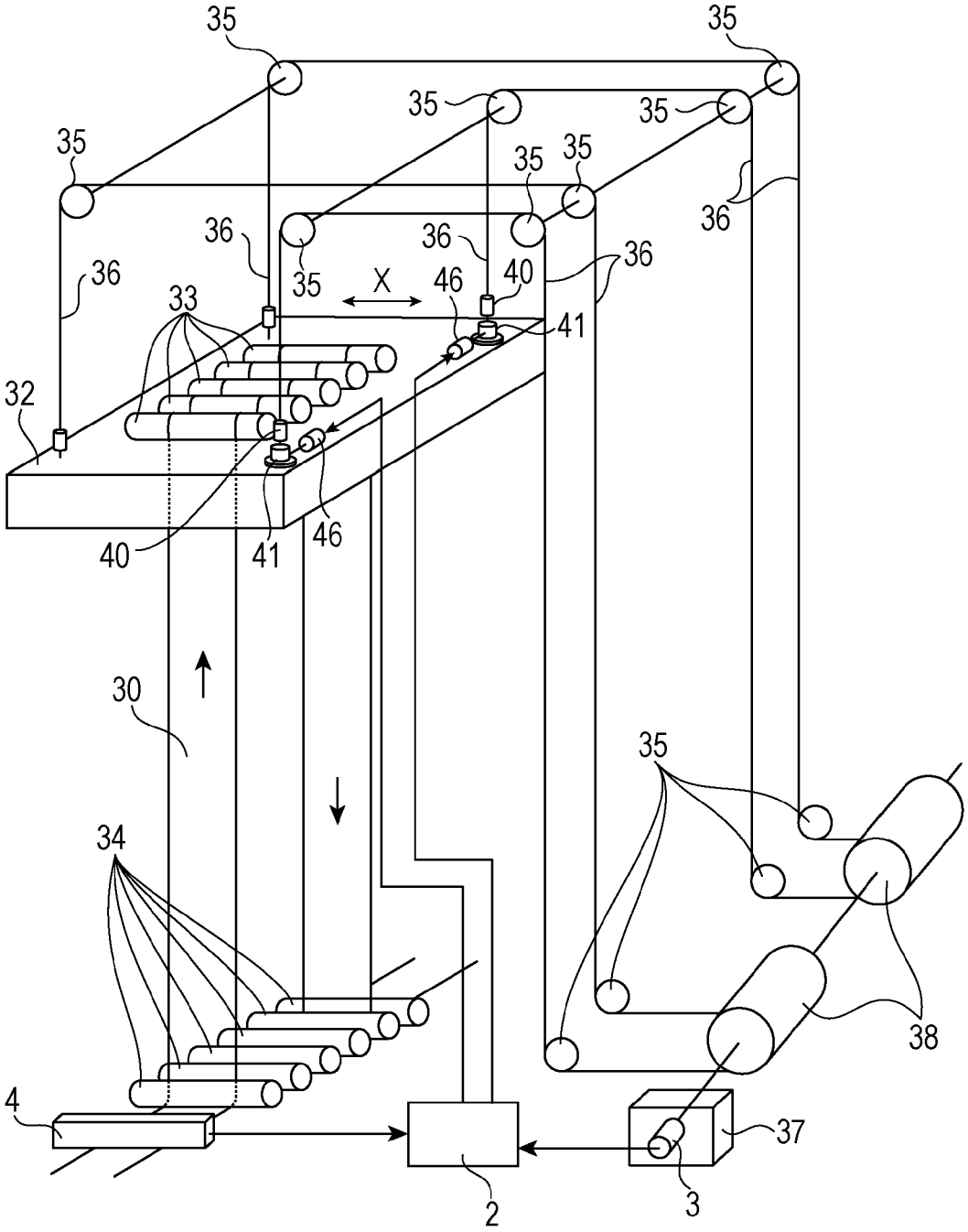
FIG. 1 is a perspective view illustrating a steel-sheet snaking preventing device for a wire rope type vertical looper according to a first configuration.

1: tilt meter
2: control means
3: level meter
4: snaking detector (CPC sensor)
30: steel sheet
32: looper carriage
33: upper looper roll
34: lower looper roll
35: sprocket or sheave
36: chain or wire rope
37: carriage driving mechanism

38: drive sprocket or drum
40: metal fitting
41: jack mechanism
42: edge position detector
43: displacement gauge
44: control means
46: jack mechanism driving source
50: guide roll
51: guide rail
Z: carriage height
A: amount of snaking
B: amount of raising or lowering
C: amount of tilt of a looper carriage
D: distance between bearings
E: clearance

DETAILED DESCRIPTION

First Configuration

A first configuration will now be described.

(1) In a steel-sheet snaking preventing device for a vertical looper in a steel-sheet continuous processing facility, the device includes a jack mechanism provided at each of two corners on one side of a looper carriage in a steel sheet width direction and coupled via a metal fitting to a chain or a wire rope that pulls the looper carriage; a snaking detector configured to detect the amount of snaking of a steel sheet in the looper; a level meter configured to detect a height of the looper carriage; and a means for receiving detection signals from the snaking detector and the level meter, determining the amount of raising or lowering of the corner of the looper carriage by computation, sending the determined amount of raising or lowering as a command to the jack mechanism, and controlling the amount of raising or lowering of the corner of the looper carriage by the jack mechanism.

(2) In a steel-sheet snaking preventing method for a vertical looper, the method includes, to prevent snaking of a steel sheet using the steel-sheet snaking preventing device for a vertical looper according to (1), determining the amount of raising or lowering of the corner of the looper carriage on the basis of the amount of snaking of the steel sheet and the height of the looper carriage.

(3) The steel-sheet snaking preventing method for a vertical looper according to (2), has a relationship between the amount of snaking of the steel sheet, the height position of the looper carriage, and the amount of raising or lowering of the corner of the looper carriage is determined, and the amount of raising or lowering of the corner of the looper carriage is determined using the determined relationship.

In the first configuration, each of two corners on one side of a looper carriage in the steel sheet width direction is provided with a jack mechanism coupled via a metal fitting to a chain or a wire rope that pulls the looper carriage. A snaking detector detects the amount of snaking of a steel sheet in the looper, and sends the detection signal to a control means. On the basis of the detection signal, from a relationship between the amount of snaking and the amount of raising or lowering of the corner of the looper carriage, the control means calculates the amount of raising or lowering of the jack mechanism at each corner of the looper carriage such that the amount of snaking is within an allowable range. The relationship between the amount of snaking and the amount of raising or lowering of the corner of the looper carriage varies depending on the height of the looper carriage. Therefore, the relationship between the amount of snaking and the amount of raising or lowering of the corner of the looper carriage is determined in advance in relation to the height of the looper carriage. Next, the snaking detector detects the amount of snaking of the steel sheet in the looper, and the level meter detects the height of the looper carriage. On the basis of the resulting detection signals and the relationship between the amount of snaking and the amount of raising or lowering of the corner of the looper carriage, the amount of raising or lowering B of the corner of the looper carriage (the amount of raising or lowering of the jack mechanism) is calculated such that the amount of snaking is within an allowable range. When the jack mechanism receives the amount of raising or lowering sent as a command signal from the control means, a driving source of the jack mechanism rotates a horizontal axis worm, which rotates a worm gear about a vertical axis. A vertical axis jack rotating together with the worm gear is raised or lowered with respect to the metal fitting. This facilitates correction of the tilt of the looper carriage in the steel sheet width direction and makes it possible to prevent snaking.

A concrete description of the first configuration will now be given. FIG. 1 is a perspective view illustrating a steel-sheet snaking preventing device for a wire rope type vertical looper according to an example of the first configuration.

In FIG. 1, reference numeral 30 denotes a steel sheet, reference numeral 32 denotes a looper carriage, reference numeral 33 denotes an upper looper roll, reference numeral 34 denotes a lower looper roll, reference numeral 35 denotes a sheave, reference numeral 36 denotes a wire rope, reference numeral 37 denotes a carriage driving mechanism, reference numeral 38 denotes a drum, reference numeral 40 denotes a metal fitting, reference numeral 41 denotes a jack mechanism, and reference numeral 46 denotes a jack mechanism driving source. Reference numeral 2 denotes a control means (controller), reference numeral 3 denotes a level meter, and reference numeral 4 denotes a snaking detector. The level meter 3 may be of any type as long as it is capable of calculating a carriage height. The level meter 3 detects the amount of rotation by means of a rotation detector (so-called PLG or encoder) attached to an end of a drum shaft, and calculates the carriage height.

In this device, at each of two corners on one side of the looper carriage 32 in the steel sheet width direction, the jack mechanism 41 is coupled via the metal fitting 40 to the wire rope 36 that pulls the looper carriage 32.

Figure 2:
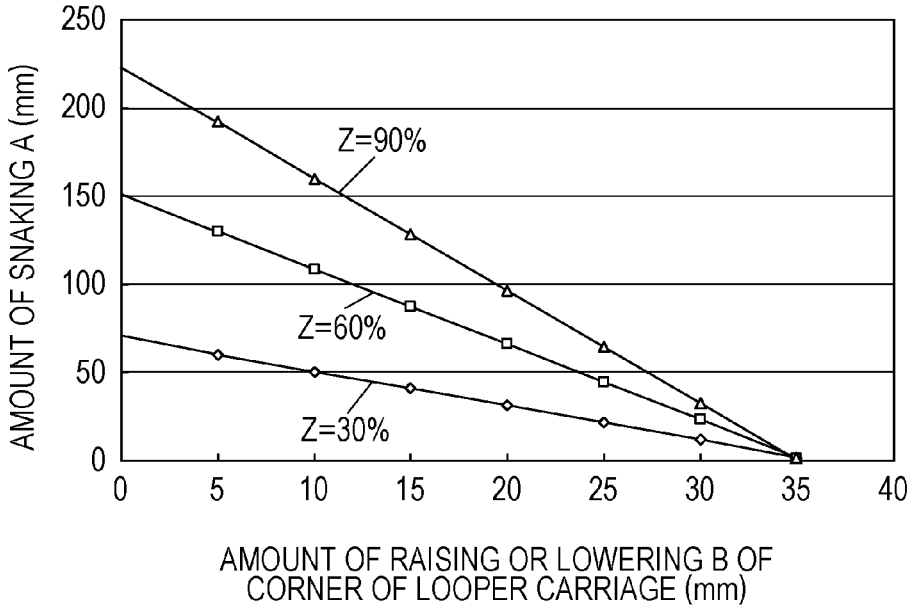
FIG. 2 shows a relationship between the amount of snaking and the amount of raising or lowering of a corner of a looper carriage according to the first configuration.

The relationship between the amount of snaking and the amount of raising or lowering of each corner of the looper carriage varies depending on the looper carriage height. Therefore, from tests in the actual facility and analysis of operating conditions, the relationship between the amount of snaking and the amount of raising or lowering of the corner of the looper carriage is determined in relation to the looper carriage height. FIG. 2 shows an exemplary relationship between the amount of snaking A and the amount of raising or lowering B of the corner of the looper carriage determined in relation to the looper carriage height Z when, in an entry-side looper in a steel-sheet continuous processing facility, a steel sheet with a thickness of 0.7 mm and a width of 1880 mm was passed through the looper carriage having no tilt and the amount of raising or lowering of the corner of the looper carriage was varied during occurrence of snaking. The carriage height Z is represented by its ratio (%) to the maximum height defined in the facility specification. The amount of snaking in FIG. 2 is the amount of rightward snaking along the X-axis in FIG. 1. The amount of raising or lowering of the corner of the looper carriage in FIG. 2 is the amount of upward movement of the corner of the looper carriage.

FIG. 2 shows that, for example, when Z=90%, the amount of snaking can be reduced from about 225 mm to about 100 mm by raising the corner of the looper carriage by about 20 mm. The amount of snaking can be reduced to zero by further raising the corner of the looper carriage by about 15 mm (i.e., 35 mm in total). Also, when Z=60%, the amount of snaking can be reduced from 150 mm to about 100 mm by raising the corner of the looper carriage by about 12 mm. The amount of snaking can be reduced to zero by further raising the corner of the looper carriage by about 23 mm (i.e., 35 mm in total).

For each steel sheet size, the relationship between the amount of snaking A and the amount of raising or lowering B of the corner of the looper carriage is stored, in the control means 2, in association with various looper carriage heights Z. An allowable range of the amount of snaking is also input and stored in the control means 2.

Typically, the looper includes a roll-out sensor that prevents the steel sheet from running off the roll. The allowable range of the amount of snaking in the looper is determined by the position of the roll-out sensor provided for preventing the steel sheet from running off the roll. For example, when the roll width W=2200 mm, the sheet width b=1880 mm, and the sensor position (distance from a roll end) x=60 mm, the allowable range is set to (W−b)/2−x=100 mm.

In this device, the snaking detector 4 detects the amount of snaking A of the steel sheet 30 in the looper and sends the detection signal to the control means 2. Also, the level meter 3 detects the looper carriage height Z and sends the detection signal to the control means 2.

On the basis of the sent detection signal representing the amount of snaking and the sent detection signal representing the looper carriage height, and using the stored relationship between the amount of snaking A, the looper carriage height Z, and the amount of raising or lowering B of the corner of the looper carriage, the control means 2 calculates the amount of raising or lowering B of the corner of the looper carriage, that is, the amount of raising or lowering of the jack mechanism 41 at which the amount of snaking A is within the allowable range.

The control means 2 sends the calculated amount of raising or lowering as a command signal to the jack mechanism 41. When the jack mechanism 41 receives the command signal from the control means 2, a driving source of the jack mechanism 41 rotates a horizontal axis worm, which rotates a worm gear about a vertical axis. A vertical axis jack rotating together with the worm gear is raised or lowered with respect to the metal fitting 40 to tilt the looper carriage in the steel sheet width direction, so that snaking can be prevented. It is also possible to prevent snaking caused by the shape of the steel sheet itself and occurring when the looper carriage 32 originally has no tilt. Since the looper carriage can be tilted in the steel sheet width direction without varying the length of the chain or wire rope, it is possible to simplify the facility.

Figure 3:
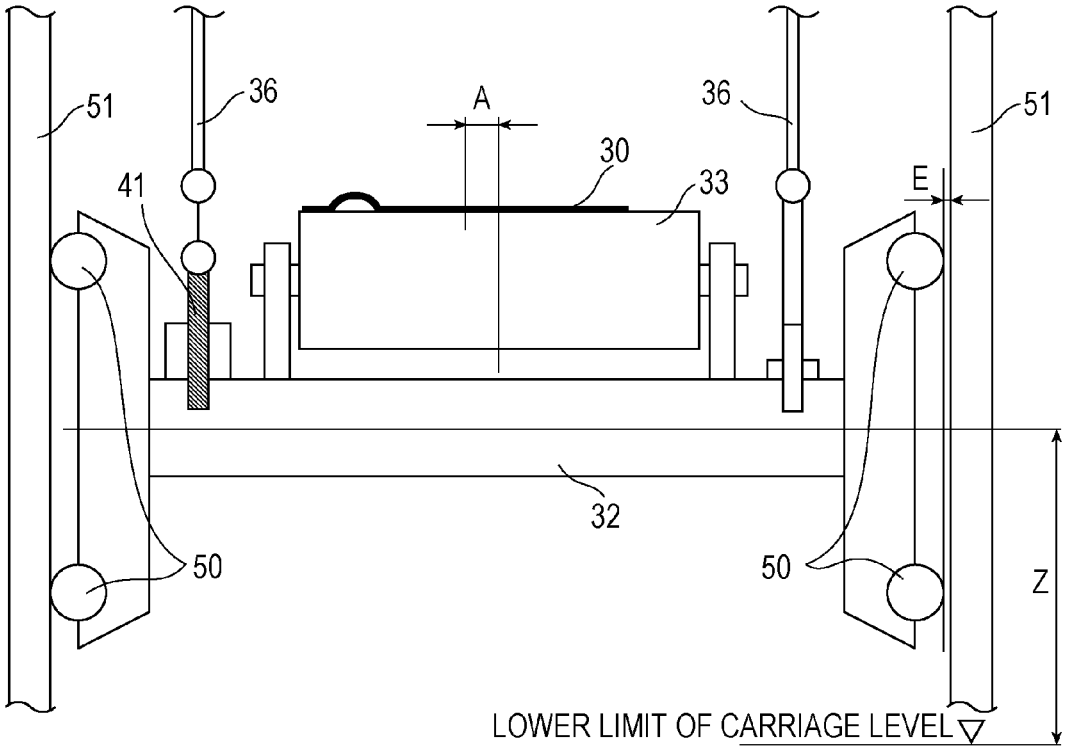
FIG. 3 is a vertical cross-sectional view illustrating how a steel sheet snakes when there is no tilt of the looper carriage according to the first configuration.

Since the looper carriage 32 is typically raised or lowered in a horizontal state, a given amount of clearance E (see FIG. 3) is provided between each guide rail 51 and guide rolls 50. A steady load is not applied to the guide rolls 50 when the looper carriage 32 has no tilt. However, when the looper carriage 32 has a tilt, the clearance E disappears and a steady load is applied to the guide rolls 50. As the tilt increases, the load also increases. As a result, the life of the guide rolls 50 is shortened.

Figure 4:
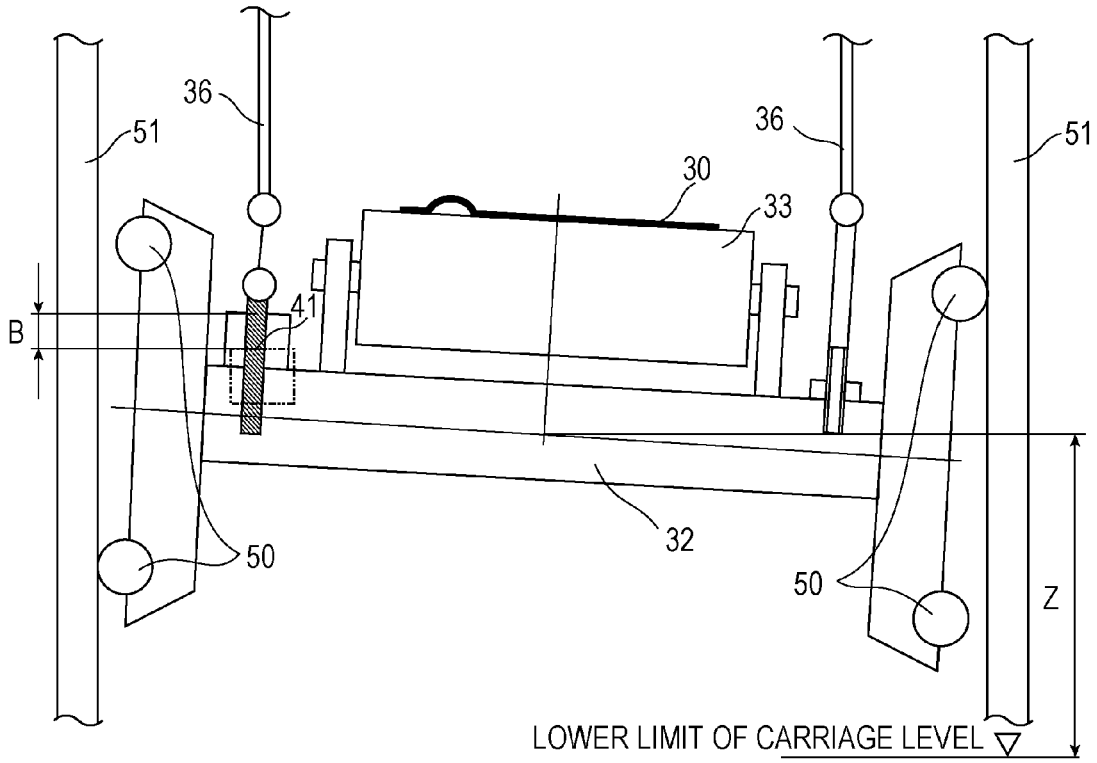
FIG. 4 is a vertical cross-sectional view illustrating a state where snaking of the steel sheet is corrected by the steel-sheet snaking preventing device for a vertical looper according to the first configuration.

In the first configuration, the amount of raising or lowering of the corner of the looper carriage is controlled, on the basis of the detection signal (the amount of snaking) from the snaking detector 4 and the detection signal from the level meter 3 such that the amount of snaking is within the allowable range. Therefore, as illustrated in FIG. 4, the tilt of the looper carriage 32 can be minimized and the load applied to the guide rolls 50 can also be minimized. This can increase the life of the guide rolls. Also, it is possible to prevent abrasion powders of the guide rolls from falling and adhering to the steel sheet.

The steel-sheet snaking preventing device for a wire rope type vertical looper has been described in the foregoing example. It is apparent that the first configuration is also applicable to a chain type vertical looper. In the chain type vertical looper, sprockets are used instead of sheaves, and drive sprockets are used instead of drums.

Second Configuration

The second configuration will now be described. In the steel-sheet snaking preventing device for a vertical looper according to the second configuration, a tilt meter detects the amount of tilt of a looper carriage and sends the detection signal to a control means. On the basis of the detection signal, the control means calculates the amount of tilt of the looper carriage at which the amount of snaking becomes zero, from a predetermined relationship between the amount of snaking of a steel sheet and the amount of tilt of the looper carriage. The relationship between the amount of snaking of the steel sheet and the amount of tilt of the looper carriage varies depending on the looper carriage height. Therefore, a level meter detects the looper carriage height and, in accordance with the detection signal from the level meter, the amount of tilt of the looper carriage at which the amount of snaking becomes zero is calculated. The control means compares the detected amount of tilt of the looper carriage with the calculated amount of tilt of the looper carriage at which the amount of snaking becomes zero. Then, if there is a difference therebetween, the control means sends a raising or lowering command to each jack mechanism. When the jack mechanism receives the command signal from the control means, a driving source of the jack mechanism rotates a horizontal axis worm, which rotates a worm gear about a vertical axis. A vertical axis jack rotating together with the worm gear is raised or lowered with respect to a metal fitting to correct the amount of tilt of the looper carriage. When the detected amount of tilt of the looper carriage becomes equal to the calculated amount of tilt of the looper carriage at which the amount of snaking becomes zero, the control means sends a stop command to the jack mechanism. As a result, the amount of tilt of the looper carriage is set to a value at which the amount of snaking becomes zero so that snaking can be prevented.

Figure 5:
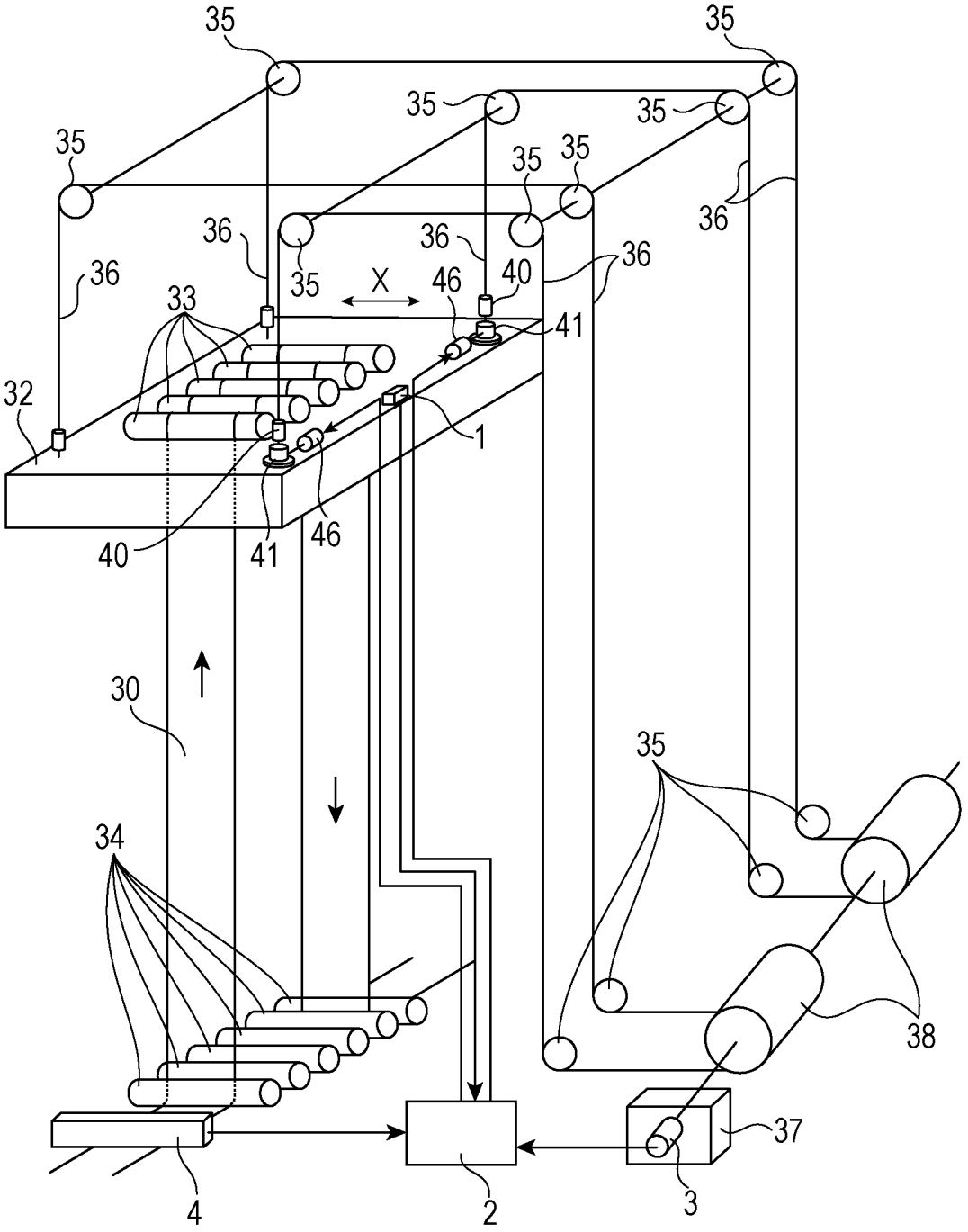
FIG. 5 is a perspective view illustrating a steel-sheet snaking preventing device for a wire rope type vertical looper according to a second configuration.

A concrete description of the second configuration will now be given. FIG. 5 is a perspective view illustrating a steel-sheet snaking preventing device for a wire rope type vertical looper according to an example of the second configuration.

In FIG. 5, reference numeral 30 denotes a steel sheet, reference numeral 32 denotes a looper carriage, reference numeral 33 denotes an upper looper roll, reference numeral 34 denotes a lower looper roll, reference numeral 35 denotes a sheave, reference numeral 36 denotes a wire rope, reference numeral 37 denotes a carriage driving mechanism, reference numeral 38 denotes a drum, reference numeral 40 denotes a metal fitting, reference numeral 41 denotes a jack mechanism, and reference numeral 46 denotes a jack mechanism driving source. Reference numeral 1 denotes a tilt meter, reference numeral 2 denotes a control means (controller), and reference numeral 3 denotes a level meter. The tilt meter 1 may be of any type as long as it is capable of measuring a tilt. The tilt meter 1 used here is one that uses a pendulum, performs servo control such that the pendulum is in the center of a magnetic sensor, and calculates the amount of tilt from the amount of servo control (current output). The level meter 3 may be of any type as long as it is capable of calculating the carriage height. The level meter 3 detects the amount of rotation by means of a rotation detector (so-called PLG or encoder) attached to an end of a drum shaft, and calculates the carriage height.

In this device, at each of two corners on one side of the looper carriage 32 in the steel sheet width direction (i.e., at each of at least two corners of the looper carriage), the jack mechanism 41 is coupled via the metal fitting 40 to the wire rope 36 that pulls the looper carriage 32.

Figure 6:
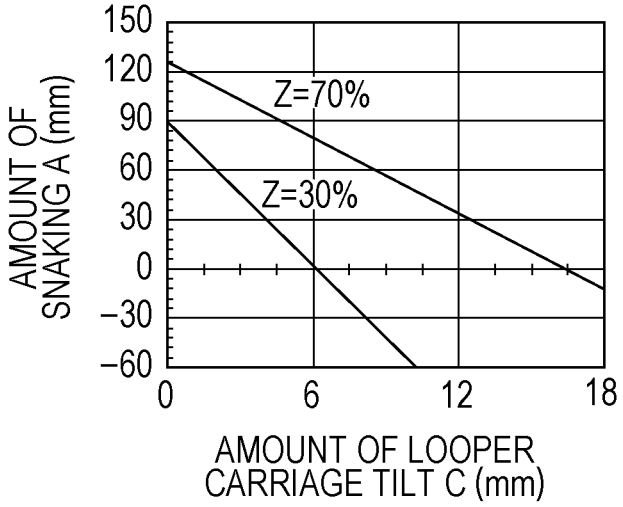
FIG. 6 shows a relationship between the amount of snaking and the amount of tilt of a looper carriage according to the second configuration.
Figure 8:
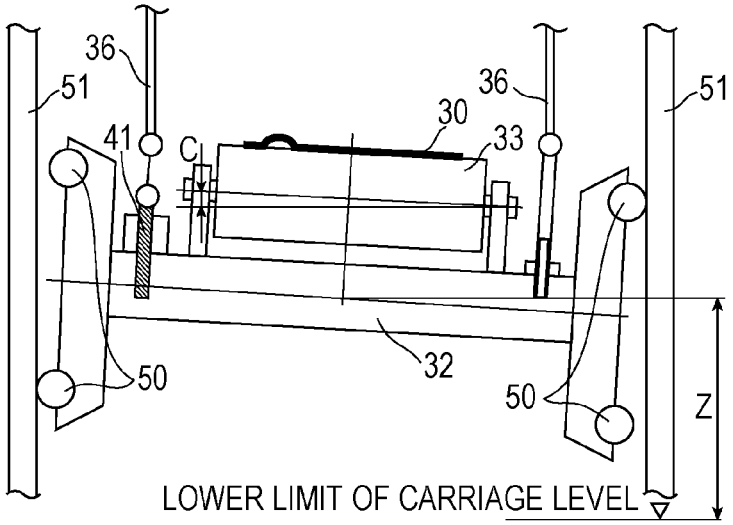
FIG. 8 is a cross-sectional view illustrating a state where snaking of the steel sheet is corrected by the steel-sheet snaking preventing device for a vertical looper according to the second configuration.

The relationship between the amount of snaking and the amount of tilt of the looper carriage varies depending on the looper carriage height. Therefore, from tests in the actual facility and analysis of operating conditions, the relationship is determined in advance in relation to the looper carriage height. FIG. 6 shows an exemplary relationship between the amount of snaking A and the amount of tilt C of the looper carriage determined in relation to the looper carriage height Z when, in an entry-side looper in a steel-sheet continuous processing facility, a steel sheet with a thickness of 1.2 mm and a width of 1781 mm was passed through the looper carriage having no tilt and the amount of tilt of the looper carriage was varied during occurrence of snaking. The amount of snaking was measured by a CPC sensor 4 that detects the position of the steel sheet in the width direction. The looper carriage height Z is represented by its ratio (%) to the maximum height defined in the facility specification. The amount of snaking in FIG. 6 is the amount of rightward snaking along the X-axis in FIG. 5. As illustrated in FIG. 8, the amount of tilt of the looper carriage is the amount of raising of the right side bearing of the upper looper roll 33 with respect to the left side bearing.

Figure 7:
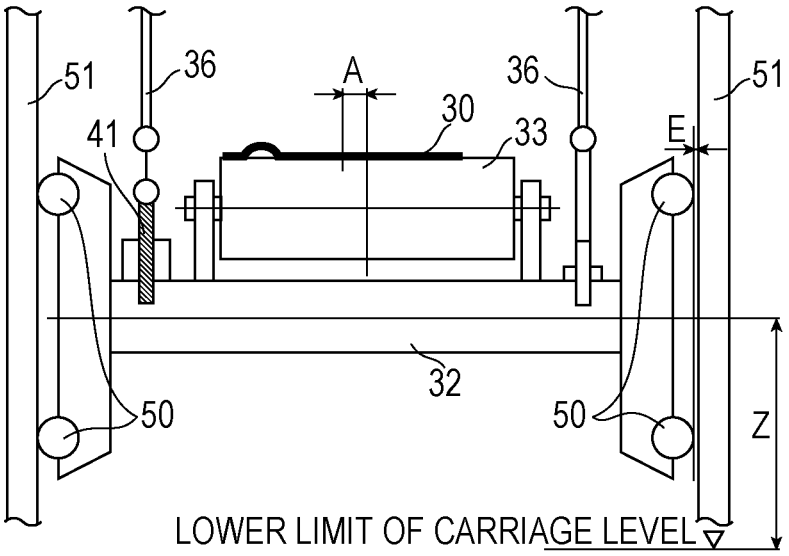
FIG. 7 is a cross-sectional view illustrating how a steel sheet snakes when there is no tilt of the looper carriage according to the second configuration.

Since the looper carriage 32 is typically raised or lowered in a horizontal state, a given amount of clearance E (see FIG. 7) is provided between each guide rail 51 and guide rolls 50.

In the second configuration, the amount of tilt of the looper carriage at which the amount of snaking becomes zero is controlled on the basis of the detection signal from the tilt meter 1 and the detection signal from the level meter 3 (see FIG. 8).

FIG. 6 shows that, for example, when Z=70%, the amount of snaking can be reduced from about 125 mm to about 35 mm by raising the right side bearing of the upper looper roll by about 12 mm. The amount of snaking can be reduced to zero by further raising the right side bearing of the upper looper roll by about 4.5 mm (i.e., 16.5 mm in total). Also, when Z=30%, the amount of snaking can be reduced from about 90 mm to about 30 mm by raising the right side bearing of the upper looper roll by about 4 mm. The amount of snaking can be reduced to zero by further raising the right side bearing of the upper looper roll by about 2 mm (i.e., 6 mm in total).

For each steel sheet size, the relationship between the amount of snaking A and the amount of tilt C of the looper carriage is stored, in the control means 2, in association with various looper carriage heights Z. An allowable range of the amount of snaking is also input and stored in the control means 2.

Figure 9:
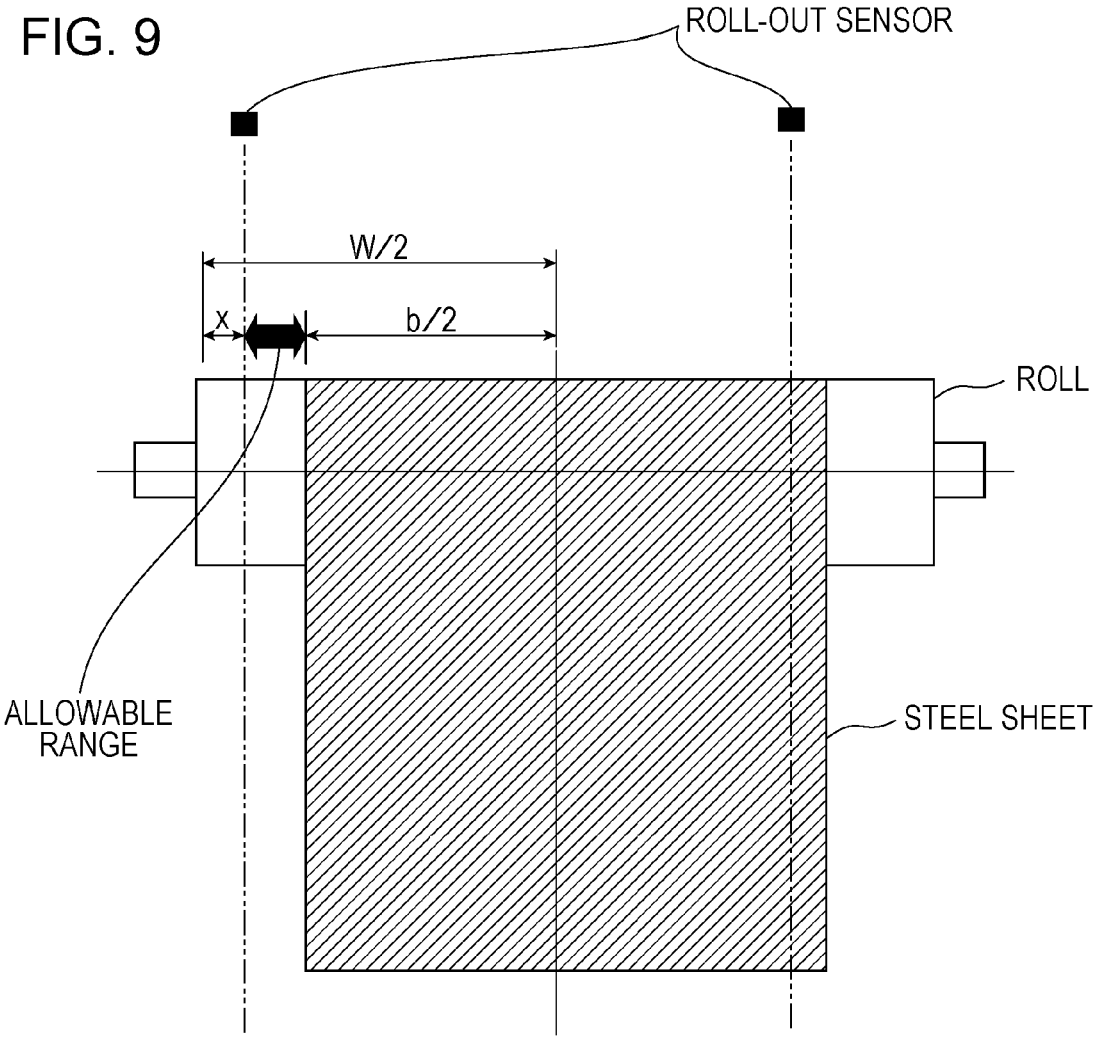
FIG. 9 illustrates an allowable range of the amount of snaking in the vertical looper according to the second configuration.

Typically, the looper includes a roll-out sensor that prevents the steel sheet from running off the roll. The allowable range of the amount of snaking in the looper is determined by the position of the roll-out sensor provided for preventing the steel sheet from running off the roll. For example, when the roll width W=2200 mm, the sheet width b=1880 mm, and the sensor position (distance from a roll end) x=60 mm, the allowable range is (W−b)/2−x=100 mm (see FIG. 9).

In this device, the tilt meter 1 detects the amount of tilt of the looper carriage 32 and sends the detection signal to the control means 2. On the basis of the detection signal, the control means 2 calculates, from the relationship between the amount of snaking and the amount of tilt of the looper carriage 32, the amount of tilt of the looper carriage 32 at which the amount of snaking becomes zero. The relationship between the amount of snaking and the amount of tilt of the looper carriage 32 varies depending on the height of the looper carriage 32. Therefore, the level meter 3 detects the height of the looper carriage 32. Then, in accordance with the detection signal from the level meter, the amount of tilt of the looper carriage 32 at which the amount of snaking becomes zero is calculated in advance in relation to the height of the looper carriage 32, from tests in the actual facility and analysis of operating conditions.

The control means 2 compares the detected amount of tilt of the looper carriage 32 with the calculated amount of tilt of the looper carriage 32 at which the amount of snaking becomes zero. Then, if there is a difference therebetween, the control means 2 sends a raising or lowering command to each jack mechanism 41. When the jack mechanism 41 receives the command signal from the control means, the jack mechanism driving source 46 rotates a horizontal axis worm, which rotates a worm gear about a vertical axis. A vertical axis jack rotating together with the worm gear is raised or lowered with respect to the metal fitting 40 to correct the amount of tilt of the looper carriage 32. When the detected amount of tilt of the looper carriage 32 becomes equal to the calculated amount of tilt of the looper carriage 32 at which the amount of snaking becomes zero, the control means 2 sends a stop command to the jack mechanism 41. As a result, the amount of tilt of the looper carriage 32 is set to a value at which the amount of snaking becomes zero so that snaking can be prevented. From tests in the actual facility and analysis of operating conditions, the amount of tilt of the looper carriage 32 at which the amount of snaking becomes zero is calculated in advance in relation to the height of the looper carriage 32. Thus, it is also possible to prevent snaking caused by the shape of the steel sheet itself and occurring when the looper carriage 32 originally has no tilt. Since the looper carriage can be tilted in the steel sheet width direction without varying the length of the chain or wire rope, it is possible to simplify the facility.

A steel-sheet snaking preventing device for a wire rope type vertical looper has been described in the foregoing example. It is apparent that the second configuration is also applicable to a chain type vertical looper. In the chain type vertical looper, sprockets are used instead of sheaves, and drive sprockets are used instead of drums.

Third Configuration

The third configuration will now be described. In the steel-sheet snaking preventing device for a vertical looper according to the third configuration, a snaking detector detects the amount of snaking of a steel sheet in the looper, a tilt meter detects the amount of tilt of a looper carriage, and the resulting detection signals are sent to a control means. On the basis of the detection signals, the control means sends a command to correct the amount of raising or lowering to a jack mechanism at each corner of the carriage to minimize the amount of snaking of the steel sheet. When the jack mechanism receives the command signal from the control means, a jack mechanism driving source rotates a horizontal axis worm, which rotates a worm gear about a vertical axis. A vertical axis jack rotating together with the worm gear is raised or lowered with respect to a metal fitting to vary the amount of tilt of the looper carriage through each chain or wire rope that pulls the looper carriage.

For the amount of tilt of the looper carriage, depending on the looper carriage height, there is an allowable amount of tilt at which one-sided elongation of the steel sheet does not occur. Therefore, a level meter detects the looper carriage height. Then, in accordance with the detection signal from the level meter, if the amount of tilt of the looper carriage reaches the allowable amount of tilt at which one-sided elongation of the steel sheet does not occur, the command sent to each jack mechanism to correct the amount of raising or lowering is stopped, and the tilting of the looper carriage is stopped. Therefore, even in a location where the looper stroke is short, it is possible to prevent snaking without one-sided elongation of the steel sheet caused by the tilt of the looper carriage.

Figure 10:
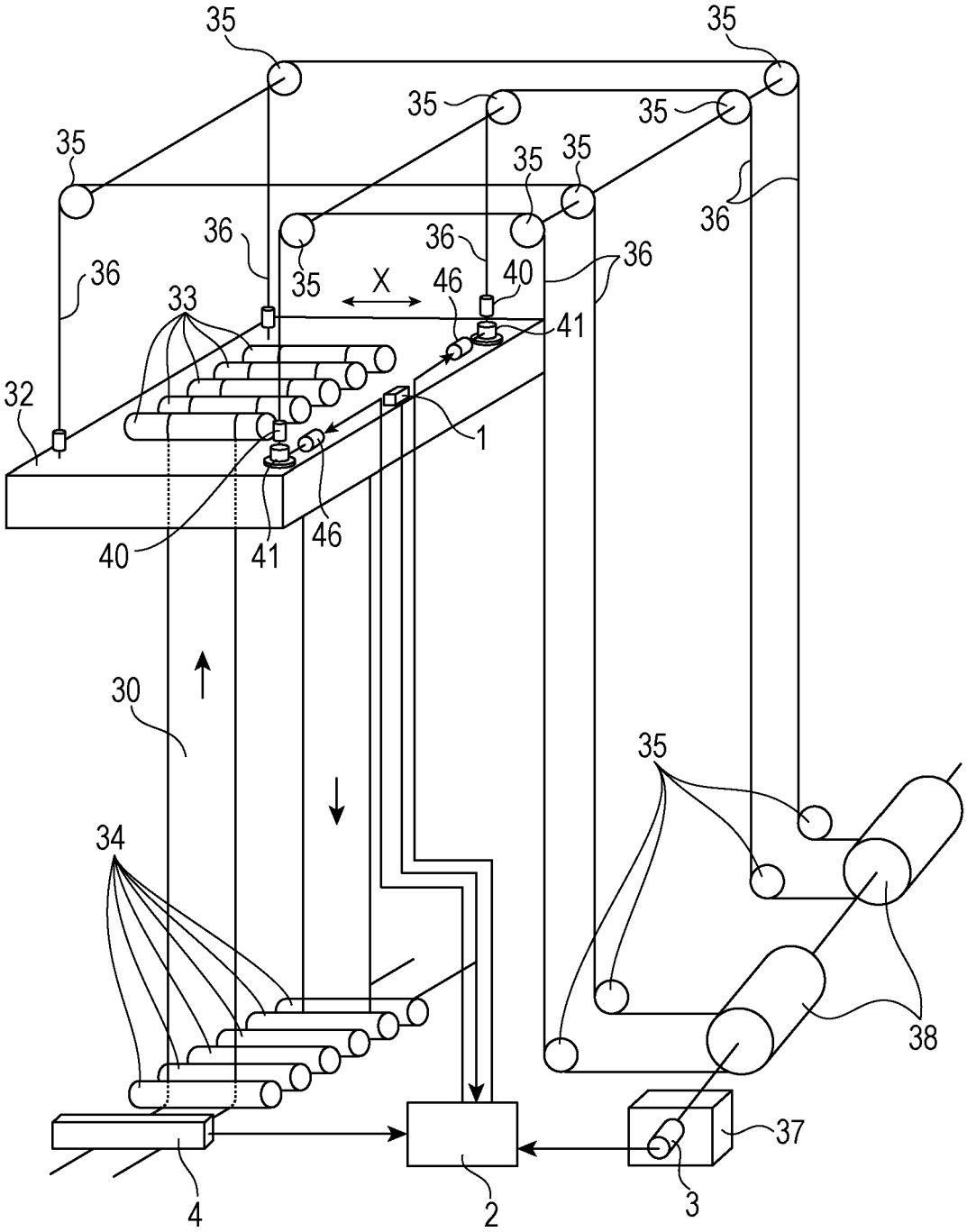
FIG. 10 is a perspective view illustrating a steel-sheet snaking preventing device for a wire rope type vertical looper according to a third configuration.

A concrete description of the third configuration will now be given. FIG. 10 is a perspective view illustrating a steel-sheet snaking preventing device for a wire rope type vertical looper according to an example of the third configuration.

In FIG. 10, reference numeral 30 denotes a steel sheet, reference numeral 32 denotes a looper carriage, reference numeral 33 denotes an upper looper roll, reference numeral 34 denotes a lower looper roll, reference numeral 35 denotes a sheave, reference numeral 36 denotes a wire rope, reference numeral 37 denotes a carriage driving mechanism, reference numeral 38 denotes a drum, reference numeral 40 denotes a metal fitting, reference numeral 41 denotes a jack mechanism, and reference numeral 46 denotes a jack mechanism driving source. Reference numeral 1 denotes a tilt meter, reference numeral 2 denotes a control means (controller), reference numeral 3 denotes a level meter, and reference numeral 4 denotes a snaking detector (CPC sensor). The tilt meter 1 may be of any type as long as it is capable of measuring a tilt. The tilt meter 1 used here is one that uses a pendulum, performs servo control such that the pendulum is in the center of a magnetic sensor, and calculates the amount of tilt from the amount of servo control (current output). The level meter 3 may be of any type as long as it is capable of calculating the carriage height. The level meter 3 detects the amount of rotation by means of a rotation detector (so-called PLG or encoder) attached to an end of a drum shaft, and calculates the carriage height.

In this device, at each of two corners on one side of the looper carriage 32 in the steel sheet width direction (i.e., at each of at least two corners of the looper carriage), the jack mechanism 41 is coupled via the metal fitting 40 to the wire rope 36 that pulls the looper carriage 32.

Figure 11:
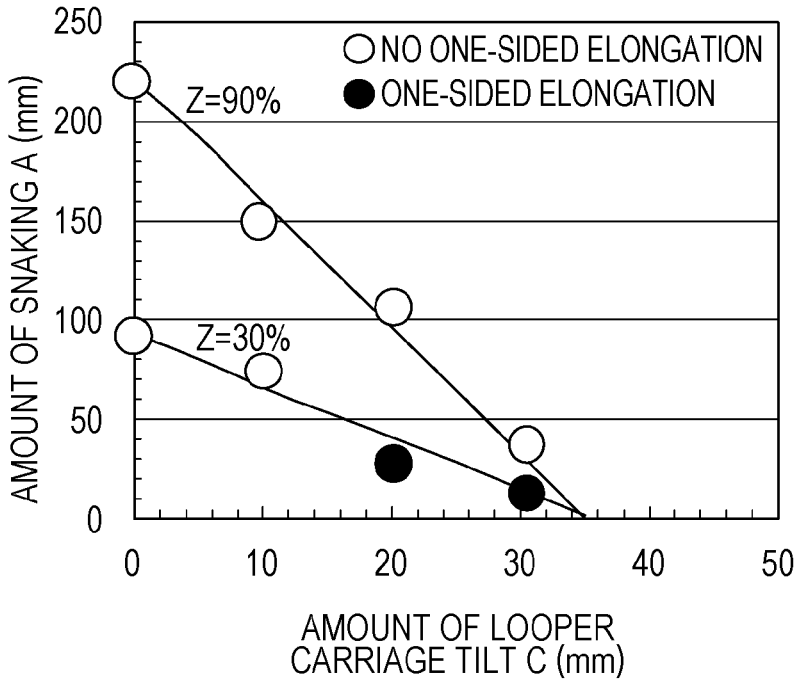
FIG. 11 shows a relationship between the amount of snaking and the amount of tilt of a looper carriage according to the third configuration.
Figure 13:
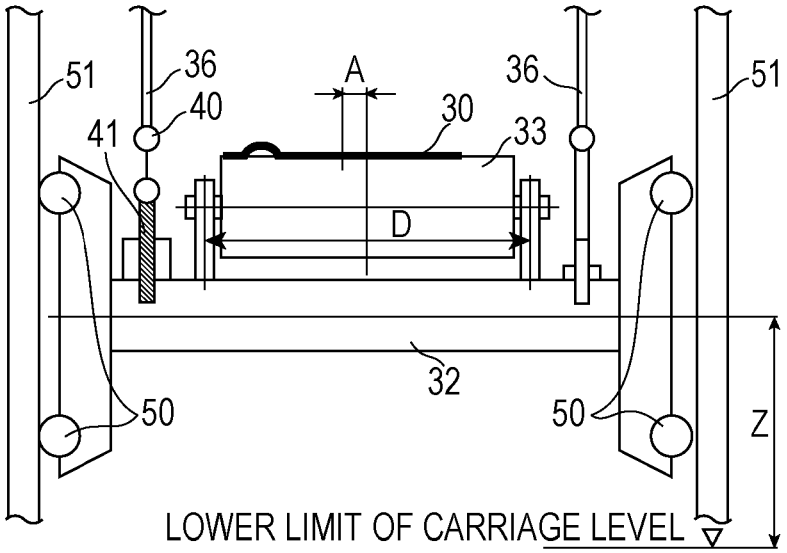
FIG. 13 is a cross-sectional view illustrating how a steel sheet snakes when there is no tilt of the looper carriage according to the third configuration.
Figure 14:
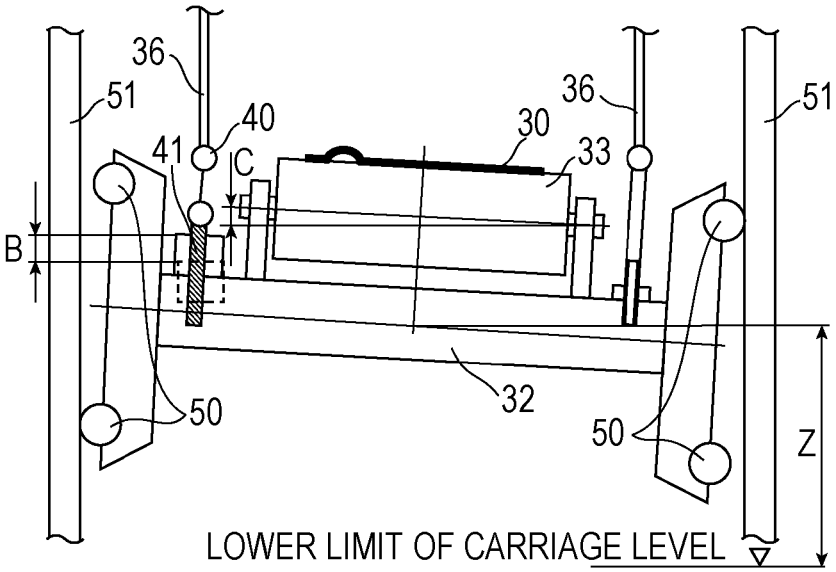
FIG. 14 is a cross-sectional view illustrating a state where snaking of the steel sheet is corrected by the steel-sheet snaking preventing device for a vertical looper according to the third configuration.

The relationship between the amount of tilt of the looper carriage and the amount of snaking varies depending on the looper carriage height. Therefore, from tests in the actual facility and analysis of operating conditions, the relationship between the amount of tilt of the looper carriage and the amount of snaking is determined in advance in relation to the looper carriage height. FIG. 11 shows an exemplary relationship between the amount of snaking A and the amount of tilt C of the looper carriage determined in relation to the looper carriage height Z when, in an entry-side looper in a steel-sheet continuous processing facility, a steel sheet (mild steel) with a thickness of 0.8 mm and a width of 1880 mm was passed through the looper carriage 32 having no tilt (see FIG. 13) and the looper carriage height was varied during occurrence of snaking. The amount of snaking was measured by a CPC sensor (snaking detector 4) that detects the position of the steel sheet in the width direction. The looper carriage height Z is represented by its ratio (%) to the maximum height defined in the facility specification. The amount of snaking in FIG. 11 is the amount of rightward snaking along the X-axis in FIG. 10. As illustrated in FIG. 14, the amount of tilt of the looper carriage is the amount of raising of the right side bearing of the upper looper roll 33 with respect to the left side bearing.

Figure 12:
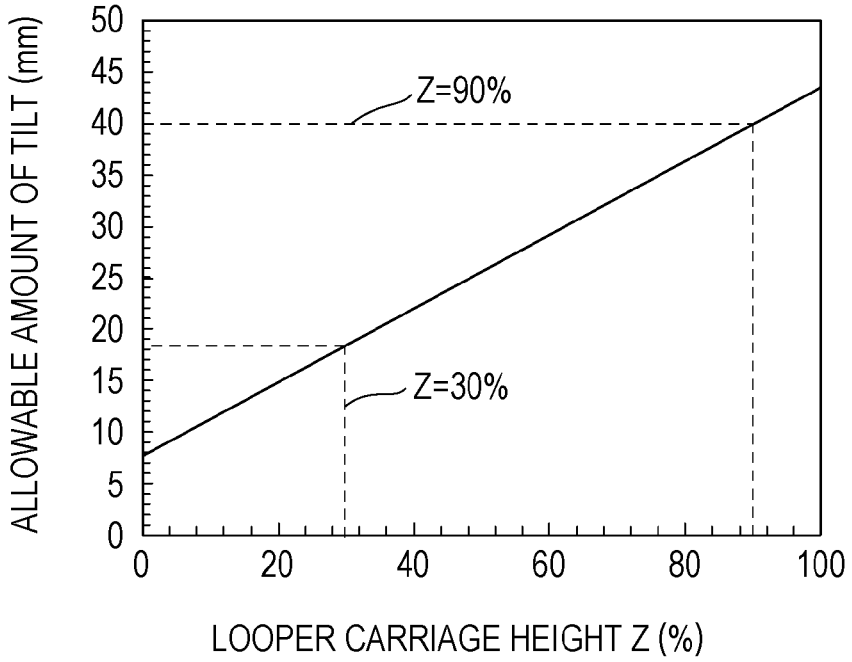
FIG. 12 shows a relationship between the looper carriage height Z and the allowable amount of tilt (the maximum value of the amount of tilt C at which one-sided elongation does not occur).

The allowable amount of tilt at which one-sided elongation of the steel sheet does not occur varies depending on the looper carriage height. Therefore, from tests in the actual facility and analysis of operating conditions, the allowable amount of tilt at which one-sided elongation of the steel sheet does not occur is determined in advance in relation to the looper carriage height. FIG. 12 shows an exemplary relationship between the looper carriage height Z and the allowable amount of tilt (the maximum amount of tilt C at which one-sided elongation does not occur) determined when, in an entry-side looper in a steel-sheet continuous processing facility, a steel sheet (mild steel) with a thickness of 0.8 mm and a width of 1880 mm was passed through the looper carriage 32 having no tilt. A tensile stress $\sigma$ (N/mm$^2$) applied to an end portion of the steel sheet by tilting the looper carriage can be expressed as $\sigma=E\cdot\epsilon=E\cdot(\delta/L)$, where $\delta$ (mm) is an elongation at the end portion of the steel sheet, $\epsilon$ is an elongation strain, L (mm) is the steel sheet length between the upper and lower rolls, and E (N/mm$^2$) is the longitudinal elastic modulus of the steel sheet. If a value obtained by adding the unit tension UT of the steel sheet (which is obtained by dividing the steel sheet tension by the cross-sectional area of the steel sheet) to the tensile stress $\sigma$ exceeds the yield point $\sigma y$ of the steel sheet ($\sigma y<\sigma+UT$), the end portion of the steel sheet is plastically deformed and this causes one-sided elongation. The amount of tilt C is expressed as $\delta\times D/E$, where D is the distance between bearings. Thus, the relationship between the looper carriage height Z and the allowable amount of tilt (the maximum amount of tilt C at which one-sided elongation does not occur) shown in FIG. 12 is obtained. For example, when Z=90%, the allowable amount of tilt is 40 mm, and when Z=30%, the allowable amount of tilt is 18 mm.

In the third configuration, on the basis of the detection signal from the tilt meter 1 and the detection signal from the snaking detector 4, the amount of tilt C of the looper carriage at which the amount of snaking is minimized is controlled by the amount of raising or lowering B of the jack mechanism 41 (see FIG. 14).

For each size, the relationship between the amount of tilt of the looper carriage and the amount of snaking is stored, in the control means 2, in association with various looper carriage heights Z. An allowable amount of tilt at which one-sided elongation of the steel sheet does not occur (the maximum amount of tilt C at which one-sided elongation does not occur) is also input and stored in the control means 2.

In this device, the tilt meter 1 detects the amount of tilt C of the looper carriage 32, and the snaking detector 4 detects the amount of snaking A of the steel sheet 30 in the looper. Next, the detection signals from the tilt meter 1 and the snaking detector 4 are sent to the control means 2. On the basis of the detection signals, the control means 2 calculates the amount of tilt of the looper carriage at which the amount of snaking of the steel sheet is minimized. The amount of tilt of the looper carriage at which the amount of snaking of the steel sheet is minimized is calculated in advance in relation to the height of the looper carriage 32.

At this point, the level meter 3 detects the looper carriage height. In accordance with the detection signal from the level meter 3, the control means 2 compares the amount of tilt of the looper carriage detected by the tilt meter 1 with the allowable amount of tilt at which one-sided elongation of the steel sheet does not occur. On the basis of the comparison, the control means 2 sends a raising or lowering command to the jack mechanism 41 at each corner of the looper carriage such that, for example, the amount of snaking of the steel sheet is minimized, that is, such that the amount of tilt of the looper carriage detected by the tilt meter 1 becomes equal to the allowable amount of tilt at which one-sided elongation of the steel sheet does not occur. When the jack mechanism 41 receives the command signal from the control means 2, the jack mechanism driving source 46 rotates a horizontal axis worm, which rotates a worm gear about a vertical axis. A vertical axis jack rotating together with the worm gear is raised or lowered with respect to the metal fitting 40 to vary the amount of tilt of the looper carriage 32. When the amount of tilt of the looper carriage reaches the allowable amount of tilt at which one-sided elongation of the steel sheet does not occur, the control means 2 stops the raising or lowering command for the jack mechanisms 41. As a result, the tilting of the looper carriage 32 is stopped. Thus, even in a location where the looper stroke is short, it is possible to prevent snaking without one-sided elongation of the steel sheet caused by the tilt of the looper carriage. Since the looper carriage can be tilted in the steel sheet width direction without varying the length of the chain or wire rope, it is possible to simplify the facility.

A steel-sheet snaking preventing device for a wire rope type vertical looper has been described in the foregoing example. It is apparent that the third configuration is also applicable to a chain type vertical looper. In the chain type vertical looper, sprockets are used instead of sheaves, and drive sprockets are used instead of drums.

EXAMPLE 1

Figure 15:
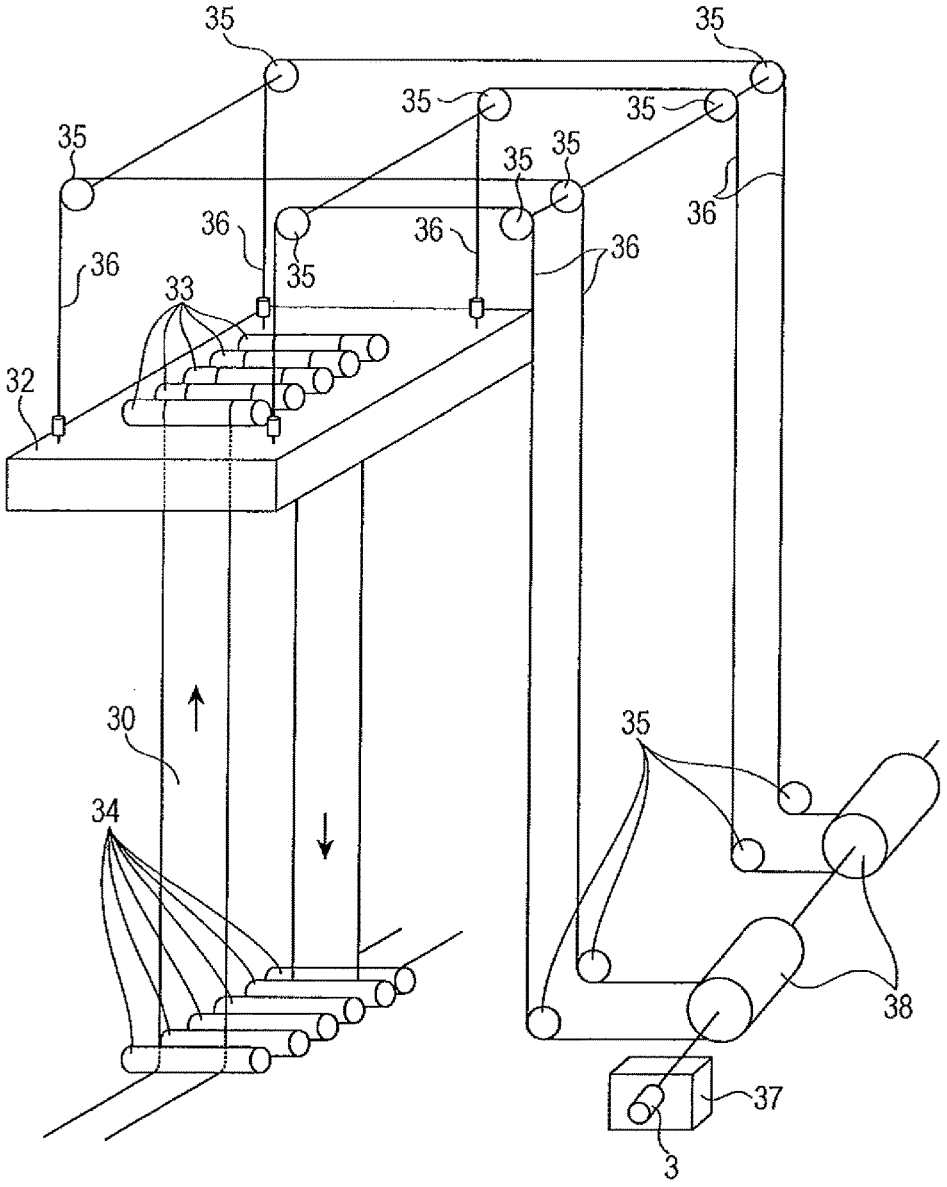
FIG. 15 is a perspective view illustrating a conventional wire rope type vertical looper.
Figure 16:
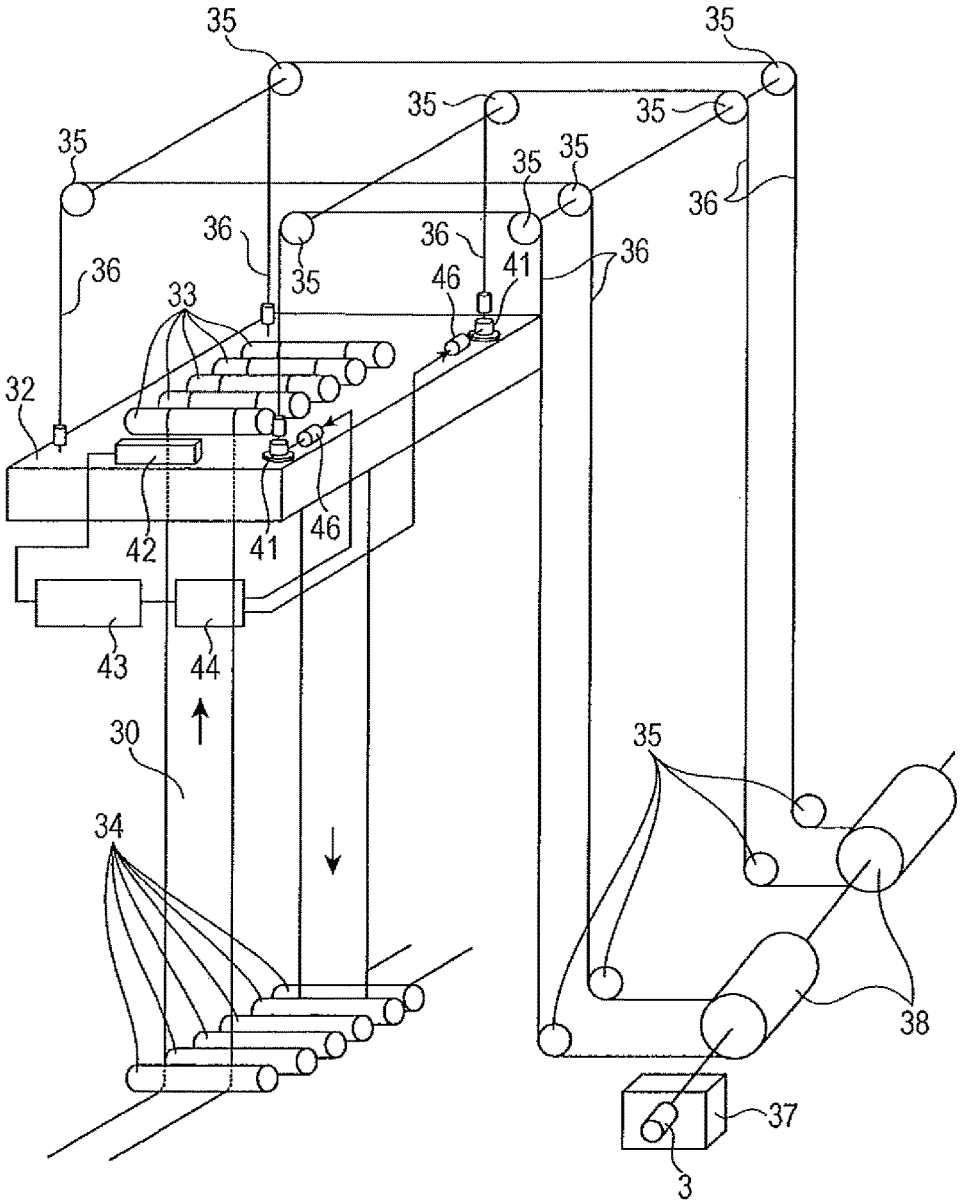
FIG. 16 is a perspective view illustrating a conventional steel-sheet snaking preventing device for a wire rope type vertical looper.

In the vertical looper described in this example, the allowable range of the amount of snaking is 100 mm or less. In this vertical looper, when the looper carriage is not tilted (FIG. 3) and the looper carriage height Z is 60%, the amount of snaking A of the steel sheet having an uneven end shape is 150 mm. The conventional device (FIG. 15), which is unable to reduce the amount of snaking, needs to be used with the looper carriage height Z restricted to prevent the steel sheet from running off the upper looper roll 33.

On the other hand, in the device according to the first configuration, when the looper carriage height Z is 90%, the amount of snaking can be made 100 mm or less if the amount of raising or lowering B of the corner of the looper carriage is 20 mm. When the looper carriage height Z is 60%, the amount of snaking can be made 100 mm or less if the amount of raising or lowering B of the corner of the looper carriage is 12 mm. When the looper carriage height Z is 30%, there is no need to adjust the amount of raising or lowering of the corner of the looper carriage.

In the device according to the first configuration, if the amount of raising or lowering B of the corner of the looper carriage is 35 mm, the amount of snaking is 0 mm and a good snaking preventing effect is achieved even when the looper carriage height Z is 90%.

EXAMPLE 2

In the vertical looper described in this example, when the looper carriage is not tilted (FIG. 7) and the looper carriage height Z is 70%, the amount of snaking A of the steel sheet having an uneven end shape is 125 mm, which is measured by the CPC sensor. Since the amount of snaking cannot be reduced by the conventional technique, the looper carriage height Z needs to be restricted to prevent the steel sheet from running off the upper looper roll 33.

In the device according to the second configuration, when the amount of tilt C of the looper carriage is 16.5 mm, the amount of snaking A is 0 mm and a good result can be obtained.

EXAMPLE 3

In the vertical looper described in this example, when the looper carriage is not tilted (FIG. 13) and the looper carriage height Z is 30%, the amount of snaking A of the steel sheet having an uneven end shape is 90 mm, which is measured by the CPC sensor. In the conventional technique, when the amount of tilt of the looper carriage is 19 mm or more, one-sided elongation of the steel sheet occurs even though the amount of snaking can be reduced.

In the device according to the third configuration, as shown in FIG. 12, when Z=30% and the amount of tilt of the looper carriage is less than 18 mm, which is the allowable amount of tilt, the amount of snaking can be reduced from 90 mm and a good result can be achieved without causing one-sided elongation of the steel sheet.

The invention claimed is:

1. A steel-sheet snaking preventing device for a vertical looper, the device comprising:

a jack mechanism provided at each of at least two corners of a looper carriage and coupled via a metal fitting to a chain or a wire rope that pulls the looper carriage;

a tilt meter configured to detect an amount of tilt of the looper carriage;

a level meter configured to detect a height of the looper carriage;

a signal detection receiver configured to receive detection signals from the tilt meter and the level meter; and a controller configured to determine the amount of tilt of the looper carriage at which the amount of snaking of a steel sheet becomes zero based on the detection signal from the level meter, send the determined amount of tilt of the looper carriage as a command to the jack mechanism, and control the amount of tilt of the looper carriage by the jack mechanism.

2. A steel-sheet snaking preventing device for a vertical looper, the device comprising:

a jack mechanism provided at each of at least two corners of a looper carriage and coupled via a metal fitting to a chain or a wire rope that pulls the looper carriage; a tilt meter configured to detect an amount of tilt of the looper carriage;

a snaking detector configured to detect an amount of snaking of a steel sheet in the looper; a level meter configured to detect a height of the looper carriage;

a signal detection receiver configured to receive detection signals from the tilt meter, the snaking detector, and the level meter; and a controller configured to send the amount of raising or lowering of the corner of the looper carriage as a command to the jack mechanism, and control the amount of tilt of the looper carriage by the jack mechanism based on the detection signals from the tilt meter and the level meter.

3. A steel-sheet snaking preventing device for a vertical looper according to claim 2, wherein the controller determines the amount of tilt of the looper carriage such that the amount of tilt does not exceed an allowable amount of tilt at which one-sided elongation of the steel sheet does not occur, on the basis of a predetermined relationship between the amount of snaking of the steel sheet, the amount of tilt of the looper carriage, and the height of the looper carriage.

* * * * *